US010214045B2

(12) United States Patent
Mayrhofer

(10) Patent No.: US 10,214,045 B2
(45) Date of Patent: Feb. 26, 2019

(54) SECURITY ELEMENT WITH COLOUR SHIFT EFFECT AND FLUORESCENT FEATURES AND METHOD FOR PRODUCTION AND USE OF SAME

(71) Applicant: HUECK FOLIEN GES.M.B.H., Baumgartenberg (AT)

(72) Inventor: Marco Mayrhofer, Sierning (AT)

(73) Assignee: HUECK FOLIEN GES.M.B.H., Baumgartenberg (AT)

( * ) Notice: Subject to any disclaimer, the term of this patent is extended or adjusted under 35 U.S.C. 154(b) by 0 days.

(21) Appl. No.: 15/535,475

(22) PCT Filed: Nov. 26, 2015

(86) PCT No.: PCT/EP2015/002377
§ 371 (c)(1),
(2) Date: Aug. 7, 2017

(87) PCT Pub. No.: WO2016/096086
PCT Pub. Date: Jun. 23, 2016

(65) Prior Publication Data

US 2017/0334235 A1 Nov. 23, 2017

(30) Foreign Application Priority Data

Dec. 15, 2014 (AT) ..... A 903/2014

(51) Int. Cl.
*B42D 25/387* (2014.01)
*B42D 25/373* (2014.01)
(Continued)

(52) U.S. Cl.
CPC ..... *B42D 25/387* (2014.10); *B42D 25/346* (2014.10); *B42D 25/351* (2014.10);
(Continued)

(58) Field of Classification Search
CPC .. B42D 25/387; B42D 25/373; B42D 25/369; B42D 25/364; B42D 25/351; B42D 25/346
(Continued)

(56) References Cited

U.S. PATENT DOCUMENTS

2005/0118396 A1 6/2005 Isherwood et al.
2009/0317595 A1 12/2009 Brehm et al.
(Continued)

FOREIGN PATENT DOCUMENTS

EP 2 006 116 12/2008
WO 03/061980 7/2003
(Continued)

OTHER PUBLICATIONS

International Search Report dated Feb. 25, 2016 in International Application No. PCT/EP2015/002377.

*Primary Examiner* — Justin V Lewis
(74) *Attorney, Agent, or Firm* — Wenderoth, Lind & Ponack, L.L.P.

(57) ABSTRACT

The invention relates to a security element having a coating consisting of a material which has an optically variable effect, in particular a colour shift effect, and has recesses that can be recognised in transmitted light, wherein the security element comprises a support substrate, a partial layer with recesses, and a layer structure that generates a colour shift effect, characterised in that the security element, on the face which has the coating consisting of the material that has an optically variable effect, comprises one or more partial coatings consisting of a layer which has colours that are transparent in visible light and fluorescent in UV light.

14 Claims, 2 Drawing Sheets

Figure 1:
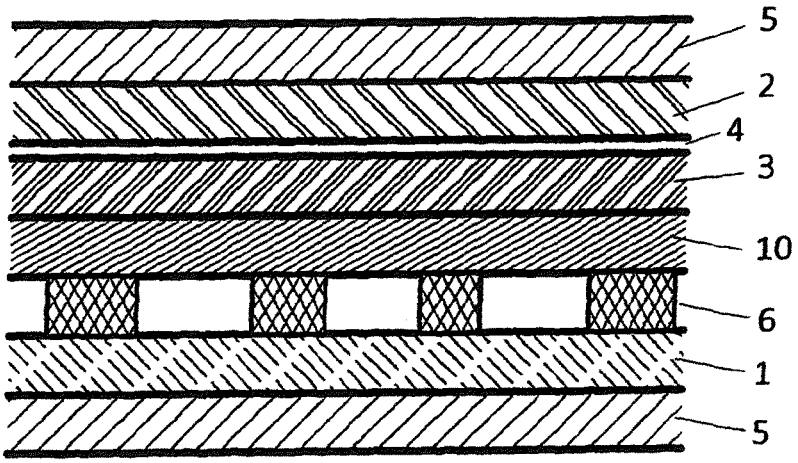

(51) Int. Cl.

| | |
|---|---|
| ***B42D 25/369*** | (2014.01) |
| ***B42D 25/364*** | (2014.01) |
| ***B42D 25/351*** | (2014.01) |
| ***B42D 25/346*** | (2014.01) |

(52) U.S. Cl.
CPC ..... *B42D 25/364* (2014.10); *B42D 25/369* (2014.10); *B42D 25/373* (2014.10)

(58) Field of Classification Search
USPC ..... 283/72, 89, 94, 98, 901
See application file for complete search history.

(56) References Cited

U.S. PATENT DOCUMENTS

| | | | |
|---|---|---|---|
| 2011/0114733 | A1 | 5/2011 | Heim |
| 2012/0068450 | A1 | 3/2012 | Macpherson et al. |
| 2012/0168515 | A1 | 7/2012 | Schutzmann et al. |

FOREIGN PATENT DOCUMENTS

| | | | | |
|---|---|---|---|---|
| WO | 2007/138255 | | 12/2007 | |
| WO | 2008/017362 | | 2/2008 | |
| WO | 2008/043981 | | 4/2008 | |
| WO | WO-2008043981 | A1 * | 4/2008 | ..... B42D 25/29 |
| WO | 2010/003646 | | 1/2010 | |
| WO | 2011/032671 | | 3/2011 | |

* cited by examiner

SECURITY ELEMENT WITH COLOUR SHIFT EFFECT AND FLUORESCENT FEATURES AND METHOD FOR PRODUCTION AND USE OF SAME

The invention relates to a security element having a color-shift effect, which additionally has recesses that can be recognized in transmitted light and fluorescent features, and a method for the production and the use of same.

Security elements which have a color-shift effect are already known. Color-shift effects can be obtained by various means, for example using thin-film interference by means of structures for example which have a layer that reflects electromagnetic waves, a spacer layer and a layer formed from metallic clusters. Such security elements are described for example in US 2005/042449 A or in EP 1 558 449 A.

Another way of obtaining a security element which has a color-shift effect is to use a coating consisting of liquid crystals, either in the form of a pigmented layer or a polymerized film.

A data carrier with a liquid crystalline security element is known from EP 0 435 129 A, wherein the material is a liquid crystal polymer, which has an oriented form and which is a solid at room temperature.

WO 00/50249 A discloses a security element which has an optically variable material, which can for example be a liquid crystalline material, and at least one additional machine-readable feature material in the same layer.

For the purpose of optimal recognition of the color-shift effect, it is necessary to provide a light-absorbing, preferably black, background. The light-absorbing, preferably black background is however clearly visible as a dark area on the rear side of a security element, such as a thread or strip for example, which is at least partially embedded in a document of value, such as a banknote or the like. This light-absorbing background must therefore be covered in order that the security element cannot be detected straightaway. This covering can be realized by means of a metallic layer for example.

A method for the production of a substrate is known from EP 1 467 873 A, which method comprises the following steps: application of a covering lacquer to at least a part of a metallic layer on a first side of a transparent polymer film, removal of metal from the areas not covered by the covering layer in order to form metal-free sections, and application of an additional layer to cover the covering lacquer and the metal-free sections, wherein the additional layer is a layer consisting of liquid crystal polymer material, and the covering lacquer is dark colored and masks the metal areas lying under same and leads to a color-change effect in the areas covered by the liquid-crystal polymer material when viewed under reflection from the first side, and wherein the contrast between the metallized areas and the metal-free areas can be easily distinguished.

In addition, security elements having a color-shift effect can be produced by means of layers with optically variable pigments.

Such pigments are known for example from US 2003/0207113 or U.S. Pat. No. 5,171,363.

These security elements can also comprise additional security features, in particular fluorescent features, which are however provided on the side facing away from the side with the optically variable effect. On the side on which the optically variable effect is visible, fluorescent colors are not used because the opacity thereof significantly compromises the recognizability of the optically variable effect.

The invention addressed the problem of providing a security element having a material which has an optically variable effect, preferably a color-shift effect, and which has recesses that can be recognized in transmitted light, wherein the security element is designed such that it both permits optimal recognition of the optically variable effect and also has, as an additional security feature, one or more coatings with fluorescent colors on the side on which the optically variable effect is recognizable, which correspond to the optical security element which has an optically variable effect.

The subject matter of the invention is therefore a security element having a coating consisting of a material which has an optically variable effect, in particular a color-shift effect, and which has recesses that can be recognized in transmitted light, wherein the security element comprises a support substrate, a partial layer with recesses, and a layer structure that generates a color-shift effect, characterized in that the security element, on the side which has the coating consisting of the material that has an optically variable effect, has one or more partial coatings consisting of a layer which has colors (pigments??) that are transparent in visible light and fluorescent in UV light.

In one embodiment, the layer structure having an optically variable effect, in particular a color-shift effect, can comprise a support substrate, and a partial layer with recesses, wherein the partial layer is formed from an opaque coating which has light-absorbing properties on the side which faces the coating consisting of the material having an optically variable effect and which has metallic coloring on the side which faces away from the coating consisting of the material having an optically variable effect, wherein the partial opaque coating consists of a light-absorbing metallic layer and a reflecting metallic layer.

The material having an optically variable effect can be a printing ink, which contains pigments consisting of liquid crystalline material. In particular, the pigments consist of cholesteric liquid crystals or a mixture of nematic and cholesteric liquid crystals.

It is additionally possible to use optically variable interference pigments (OVI pigments). Such pigments are described for example in US 2003/0207113. In another embodiment, iridescent pigments, for example Iriodin® pigments, can be used. Iriodin® pigments are based on naturally-occurring mineral flakes of mica, which are coated with semi-transparent metal oxides. Furthermore, the material having an optically variable effect can consist of a liquid crystal polymer, which is applied as a solution of the cholesteric monomers or of the mixture of cholesteric and nematic monomers and subsequently crosslinked. The crosslinking can occur thermally or by means of treatment with UV radiation or electron radiation.

In such a layer structure, when viewed in the transmitted light, the recesses can be recognized as a significant contrast compared with the areas that have a light-absorbing and a reflecting metallic layer. The security element, when embedded in a document of value, is not recognizable or is barely recognizable from the rear side even by incident light through the paper surface due to the reflecting metallic layer. However, the recesses are clearly recognizable from the rear side in transmitted light. From the front side, the optically variable effect and the recesses are clearly recognizable in incident light.

As the light-absorbing metallic layer it is possible to consider preferably non-stoichiometric aluminum oxide and stoichiometric or non-stoichiometric copper oxide. The light-absorbing metallic layer has a preferably dark to black coloring. The stronger the background absorption in the visible spectral range (350-800 nm), the stronger the visible optically variable effect.

As the reflecting metallic layer it is possible to consider metals such as Al, Sn, Cu, Zn, Pt, Au, Ag, Cr, Ti, Mo, Fe, Pd, Ni, Co or alloys thereof, for example, Cu/Al.

In one particular embodiment, the light-absorbing metallic layer can consist of non-stoichiometric aluminum oxide, preferably with an oxygen content of approximately 19-58 at %, and the reflecting metallic layer can consist of aluminum.

The recesses in the light-absorbing metallic layer and the reflecting metallic layer are perfectly congruent and can be in the form of characters, letters, numbers, images, symbols, lines, guilloche patterning and the like. Combinations of these forms are also possible.

The recesses can also be in negative form, in other words, the area around a character, a letter or the like forms the recess.

In another embodiment, the layer structure having an optically variable effect can in each case consist of at least one layer reflecting electromagnetic waves, a polymeric spacer layer and a layer formed from metallic clusters.

In this arrangement, a layer that reflects electromagnetic waves is applied to a support substrate. This layer can preferably consist of metals, such as aluminum, gold, chromium, silver, copper, tin, platinum, nickel or tantalum for example, of semiconductors, such as silicon for example, and the alloys thereof, for example nickel/chromium, copper/aluminum and the like or a printing ink with metal pigments.

The layer that reflects electromagnetic waves is applied over an entire surface or partially by means of known methods, such as spraying, vapor deposition, sputtering, or for example as printing ink by means of known printing processes (gravure printing, flexographic printing, screen printing, digital printing), by means of coating, roller application methods, slot dye methods, dip coating methods or curtain coating methods and the like. The subsequent polymeric spacer layer or the polymeric spacer layers can likewise be applied over an entire surface or preferably partially. The polymeric layers consist for example of conventional or radiation-curing, in particular UV-curing, ink- or lacquer systems based on nitrocellulose, epoxy-, polyester-, colophony-, acrylate-, alkyd-, melamine-, PVA-, PVC-, isocyanate-, urethane- or PS copolymer systems.

An entire surface or partial layer, formed from metallic clusters, is then applied to the polymeric layer. The metallic clusters can for example consist of aluminum, gold, palladium, platinum, chromium, silver, copper, nickel, tantalum, tin and the like or alloys thereof, such as Au/Pd, Cu/Ni or Cr/Ni for example.

According to the invention, the fluorescent colors have a high degree of transparency in visible light and thus do not compromise the appearance of the optically variable element.

When viewed under UV light, the fluorescent colors are then clearly recognizable (thanks to the optically active effect).

In one preferred embodiment, the fluorescent colors are coordinated with the optically active effect. For example, in a color-shift effect from gold colors to green, fluorescent colors in yellow and green can be provided on the security element, and similarly, in a color-shift effect from red to blue, fluorescent colors in red and blue can be provided.

However, it is also possible to select fluorescent colors that contrast with the color-shift effect or to select more than two different fluorescent colors. If appropriate, the fluorescent colors can also be arranged in the form of a so-called rainbow layout.

In another preferred embodiment, the fluorescent colors can be provided in bars in an alternating sequence on the security element, with the extension of the individual different fluorescent colors being able to correspond to the recesses that are recognizable in the transmitted light.

According to the invention, the fluorescent coating is created such that it appears entirely transparent in visible light.

In order to produce this coating, transparent fluorescent dyes are dissolved in a suitable solvent, for example diacetone alcohol, i-propyl alcohol, ethanol, ethoxypropanol, monoethylene glycol, methoxypropanol, methoxydipropanol, n-propanol, methoxybutanol, n-butanol, ethoxypropanol, butyl glycol, hexane, cyclopentanone, acetone, ethyl acetate, butyl acetate, cyclohexanone, i-propyl acetate, methyl ethyl ketone, methoxy propyl acetate, n-propyl acetate, special grades of petroleum spirit, toluene, water, xylene or methyl isobutyl ketone at an elevated temperature, preferably up to the boiling temperature of the solvent. Once the dye is completely dissolved, the mixture is mixed into a transparent standard lacquer. As transparent standard lacquer compositions it is possible to consider for example lacquers based on nitrocellulose, PE acrylate, PET acrylate, urethane acrylate, PVC, PMMA ethylene acrylate copolymers, styrene acrylates or epoxy acrylate, PET or PC.

As transparent fluorescent dyes, organic fluorescent dyes may be considered in particular. Particularly suitable are organic fluorescent dyes which are based, for example, on chelates, oxinates, derivatives of terephthalic acid, of anthranilic acid, whether it is benzimidazole, benzothiazole, benzoxazinone, quinazolinone, or based on thioxanthenes, salicylic acid, organic complexes of rare earth metals, in particular pigments from the Lumilux® series (Honeywell), for example Lumilux® CD 335, Lumilux® CD 740, Lumilux® CD 340, Lumilux® Red CD 335, Lumilux® Red CD 332 (red fluorescence), optical brighteners, such as Tinopal® OB, Lumilux® Blue CD 302, Lumilux® Blue CD 311, Lumilux® Blue 710, Lumilux® Blue CD 310 (blue fluorescence), Lumilux® CD 702, Lumilux® Green CD 302, Lumilux® Green CD 708, Lumilux® Green CD 308, Lumilux® Green CD 396 (green fluorescence) or Lumilux® CD 792, Lumilux® CD 797, Lumilux® CD 782, Lumilux® CD 382 (yellow green fluorescence).

The intensity of the fluorescence is dependent on the concentration of dissolved dye in the lacquer. The greatest intensity is therefore obtained when the solubility limit is reached at the boiling temperature of the solvent used. Depending on the concentration of the dye, any degree of intensity can be achieved.

As support substrates it is possible to consider for example supporting films preferably consisting of transparent flexible plastic films, for example made from PI, PP, MOPP, PE, PPS, PEEK, PEK, PEI, PSU, PAEK, LCP, PEN, PBT, PET, PA, PC, COC, POM, ABS, PVC, PTFE, ETFE (ethylene tetrafluoroethylene), PFA (tetrafluoroethylene-perfluoropropyl vinyl ether fluoro-copolymer), MFA (tetrafluoromethylene-perfluoropropyl vinyl ether fluoro-copolymer), PTFE (polytetrafluoroethylene), PVF (polyvinyl fluoride), PVDF (polyvinylidene fluoride), and EFEP (ethylene-tetrafluoroethylene-hexafluoropropylene-fluoroterpolymer).

The supporting films preferably have a thickness of 5-700 μm, preferably 5-200 μm, particularly preferably 5-50 μm.

The security element according to the invention can also comprise additional security features, which can be present in additional layers. These security features can have, for example, certain chemical, physical and also optical or optically active properties.

In order to adjust the magnetic properties of a layer, it is possible to use paramagnetic, diamagnetic and also ferromagnetic materials, such as iron, nickel and cobalt or the compounds or salts thereof (for example oxides or sulfides).

Particularly suitable are magnetic pigment colors with pigments based on Fe oxides, iron, nickel, cobalt and the alloys thereof, barium or cobalt ferrites, hard and soft magnetic iron grades and steel grades in aqueous or solvent-containing dispersions. As the solvent it is possible to consider for example i-propanol, ethyl acetate, methyl ethyl ketone, methoxypropanol and mixtures thereof.

The pigments are preferably introduced into acrylate polymer dispersions with a molecular weight of 150,000 to 300,000, into nitrocellulose, acrylate urethane dispersions, acrylate styrene dispersions or PVC-containing dispersions or into such dispersions having a solvent content.

The magnetic layer can also have a coding. Either magnetic materials with the same coercivity and/or remanence or magnetic materials with different coercivity and/or remanence can be used to form the coding.

In another embodiment, the reflecting metallic layer itself can have magnetic properties. This is achieved for example by the use of a magnetic material, such as Fe, Ni, Co.

The optical properties of the layer can be influenced by means of visible dyes or pigments, heat-sensitive colors or pigments. These can be used individually or in any possible combination.

Optically active features shall be understood here to mean diffraction structures, diffraction grating, kinegrams, holograms, DID® (zero-order microstructures in combination with thin layers).

These optically active features can be produced for example by means of known UV embossing processes of the kind described in EP 1 310 381 A for example or by means of hot embossing processes.

In order to fix the security element in or on the document of value, it is usually provided with an adhesive coating on one or both sides. This adhesive coating can be realized either in the form of a heat seal coating, a cold seal coating or a self-adhesive coating. The adhesive can also be pigmented, with the pigments used being able to be all known pigments or dyes, for example $TiO_2$, ZnS, kaolin, ATO, FTO, aluminum, chromium oxides and silicon oxides or, for example, organic pigments such as phthalocyanine blue, i-indolide yellow, dioxazine purple and the like. In addition, it is also possible to add luminescent dyes or pigments which fluoresce or phosphoresce in the visible range, in the UV range or in the IR range, and heat-sensitive colors and pigments. These can be used in all possible combinations. In addition, luminescent pigments can also be used alone or in combination with other dyes and/or pigments.

If appropriate, the security element can also be protected by means of one or more protective lacquer layer(s), which can be pigmented or unpigmented, or it can be further refined by means of laminating or the like.

Figure 2:
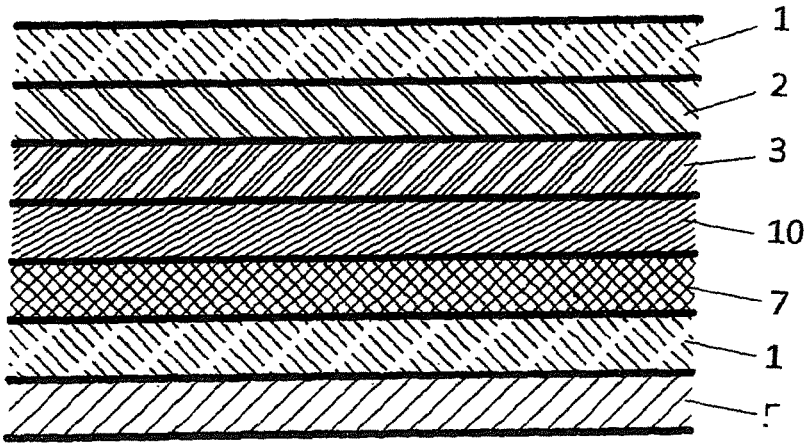
Figure 3:
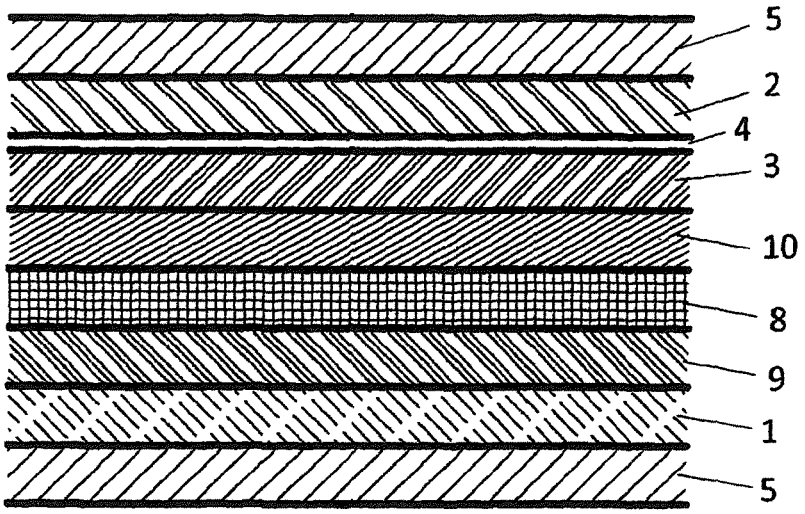
Figure 4:
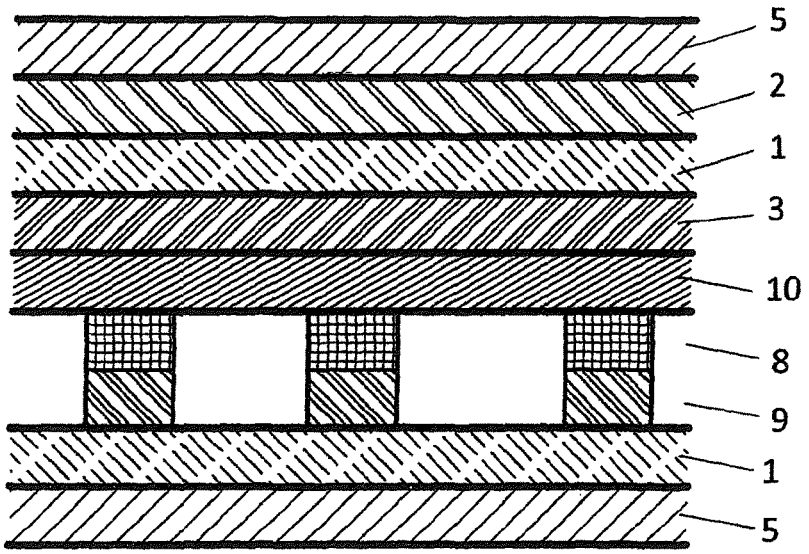

FIGS. 1 to 4 depict embodiments of the security element according to the invention.

In said figures,

1 is a support substrate,

2 is a fluorescent layer,

3 is an LC layer,

4 is an adhesion-promoting layer,

5 is an adhesive coating,

6 is a black metallization,

7 is a black print layer,

8 is a black etch-resistant layer,

9 is a metallic layer, for example an aluminum layer,

10 is a laminated adhesive layer.

The security element according to the invention is suitable for the at least partial embedding in or application onto identification, cards, banknotes or labels, seals and the like, but also as packaging material for example in the pharmaceutical, electronics and/or food industries, for example in the form of blister film, folding boxes, covers, film packaging and the like.

For the application as security features, the substrates or film materials are preferably cut into strips, threads or patches, and the width of the strips or threads can preferably be 0.5-20 mm and the patches preferably have average widths and lengths of 0.3-20 mm.

For the application in or on packaging, the film material is preferably cut into strips, bands, threads or patches, and the width of the threads, strips or bands is preferably 0.5-50 mm and the patches preferably have average widths and lengths of 2-30 mm.

The invention claimed is:

1. A security element, comprising:

a support substrate, a partial layer with recesses, a layer structure that generates a color-shift effect formed by a coating consisting of a material having an optically variable effect and a partial layer, wherein the partial layer is formed from an opaque coating consisting of (i) a light-absorbing metallic layer consisting of non-stoichiometric aluminum oxide or stoichiometric or non-stoichiometric copper oxide, and (ii) a reflecting metallic layer, and wherein the opaque coating has light-absorbing properties on a side facing the coating consisting of the material having the optically variable effect and has metallic coloring on a side facing away from the coating consisting of the material having the optically variable effect, a coating on one side of the security element consisting of a material having an optically variable effect and recesses that can be recognized in transmitted light, and at least one partial coating on the one side consisting of a layer which has colors that are transparent in visible light and fluorescent in UV light.

2. The security element according to claim 1, wherein the material having the optically variable effect is a liquid crystal polymer layer formed from cholesteric liquid crystals or a mixture of cholesteric and nematic liquid crystals.

3. The security element according to claim 1, wherein the material having the optically variable effect is a printing ink with one or more optically variable pigments selected from the group consisting of cholesteric liquid crystal pigments, a mixture of nematic and cholesteric liquid crystal pigments, optically variable interference pigments, and iridescent pigments.

4. The security element according to claim 1, wherein the reflecting metallic layer consists of at least one metal selected from the group consisting of Al, Sn, Cu, Zn, Pt, Au, Ag, Cr, Ti, Mo, Fe, Pd, Ni, Co, and alloys thereof.

5. The security element according to claim 1, wherein the recesses that can be recognized in transmitted light are in the form of positive or negative characters, letters, numbers, images, symbols, lines, guilloche patterning of a dot grid or line grid or of a halftone grid.

6. The security element according to claim 1, wherein the layer structure that generates the color-shift effect consists of at least one layer reflecting electromagnetic waves, a polymeric spacer layer and a layer formed from metallic clusters.

7. The security element according to claim 1, wherein the colors that are transparent in visible light and fluorescent in UV light are produced from organic fluorescent dyes.

8. The security element according to claim 1, wherein the colors are coordinated with a sequence of recesses.

9. The security element according to claim 1, further comprising one or more additional partial or entire-surface layers with optical, optically active, electrically conductive or magnetic properties.

10. The security element according to claim 9, wherein security element comprises a coded magnetic layer.

11. The security element according to claim 10, the coded magnetic layer consists of magnetic materials with the same or different coercivity and/or remanence.

12. The security element according to claim 1, further comprising, on one or both sides, one or more pigmented or unpigmented protective lacquer layer(s).

13. The security element according to claim 1, further comprising, on one or both sides, a pigmented or unpigmented heat seal coating, cold seal coating or self-adhesive coating.

14. The security element according to claim 1, wherein the material has a color shift effect.

* * * * *